US011667488B2

(12) United States Patent
Asakawa et al.

(10) Patent No.: US 11,667,488 B2
(45) Date of Patent: Jun. 6, 2023

(54) SHEET STACKING APPARATUS AND IMAGE FORMING APPARATUS PROVIDED WITH THE SAME

(71) Applicants: Tatsuya Asakawa, Yamanashi-ken (JP); Tetsuya Kawasaki, Yamanashi-ken (JP); Tadahito Takano, Yamanashi-ken (JP)

(72) Inventors: Tatsuya Asakawa, Yamanashi-ken (JP); Tetsuya Kawasaki, Yamanashi-ken (JP); Tadahito Takano, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 191 days.

(21) Appl. No.: 17/113,500

(22) Filed: Dec. 7, 2020

(65) Prior Publication Data

US 2021/0188587 A1 Jun. 24, 2021

(30) Foreign Application Priority Data

Dec. 20, 2019 (JP) ..... JP2019-230586
Dec. 20, 2019 (JP) ..... JP2019-230587

(51) Int. Cl.
*B65H 29/22* (2006.01)
*B65H 29/38* (2006.01)
*B65H 29/62* (2006.01)

(52) U.S. Cl.
CPC ..... *B65H 29/38* (2013.01); *B65H 29/22* (2013.01); *B65H 29/62* (2013.01)

(58) Field of Classification Search
CPC ..... B65H 29/38; B65H 29/48; B65H 31/20; B65H 2405/1111; B65H 2405/111646
See application file for complete search history.

(56) References Cited

U.S. PATENT DOCUMENTS

| | | | | |
|---|---|---|---|---|
| 7,828,279 | B2 * | 11/2010 | Hammen | H04N 1/00702 271/3.14 |
| 8,016,287 | B2 * | 9/2011 | Watanabe | B65H 31/02 271/211 |
| 9,718,284 | B2 * | 8/2017 | Hirose | B65H 31/24 |
| 10,294,059 | B2 * | 5/2019 | Tokuma | B65H 29/14 |
| 2018/0257895 | A1 * | 9/2018 | Kaneko | B65H 31/22 |

FOREIGN PATENT DOCUMENTS

| | | |
|---|---|---|
| JP | H09-278259 A | 10/1997 |
| JP | 2017-154848 A | 9/2017 |

* cited by examiner

*Primary Examiner* — Howard J Sanders
(74) *Attorney, Agent, or Firm* — Manabu Kanesaka

(57) ABSTRACT

In order to provide a sheet stacking apparatus for maintaining alignment characteristics of long-length sheets, the sheet stacking apparatus is a sheet stacking apparatus located above in a pair of sheet stacking apparatuses provided to overlap vertically along a vertical direction, and is provided with a first stacking section for stacking sheets, a second stacking section provided to extend from a downstream end of the first stacking section in a sheet transport direction and connected to the first stacking section rotatably, and a third stacking section which is attached to the second stacking section to extend from a downstream end of the second stacking section in the sheet transport direction, includes an inclined angle with respect to a horizontal surface smaller than in the second placing face, and which is attachable and detachable with respect to the second stacking section in a rotation direction.

6 Claims, 12 Drawing Sheets

SHEET STACKING APPARATUS AND IMAGE FORMING APPARATUS PROVIDED WITH THE SAME

CROSS-REFERENCE TO RELATED APPLICATION

The present application is based on and claims priorities of Japanese Patent Applications No. 2019-230586 filed on Dec. 20, 2019 and No. 2019-230587 filed on Dec. 20, 2019, the disclosure of which is incorporated herein.

TECHNICAL FIELD

The present invention relates to a sheet stacking apparatus, and more particularly, to a sheet stacking apparatus excellent in alignment characteristics and stacking characteristics to stack long-length sheets, and an image forming apparatus provided with the sheet stacking apparatus.

BACKGROUND ART

With respect to sheets used for users of image forming apparatuses such as copiers, conventionally, the longest size has been the extent of about 19 inches (size of 19 inches×13 inches) that is the maximum length in a transport direction among general normal sizes. In recent years, diversification of applications have proceeded, and the needs have grown for handling a long sheet that is the so-called "long-length sheet" with the length ranging from 26 inches to 30 inches (660.4 mm to 762 mmm) in the transport direction, and further, a longer sheet with the length of 1300 mm. In stacking such long-length sheets in sheet stacking apparatuses of conventional specifications without any modification, since the length of the stacking tray is extremely shorter than the length of the sheet, the sheet falls outside a storage position of the tray. Accordingly, in order to stack long-length sheets with the length of 30 inches, the length of the stacking tray also needs near 30 inches.

Also in such long-length sheets, many types of weighing exit as in normal sheets, and there are various sheets ranging from the so-called thin paper to thick paper.

Therefore, there is a known sheet stacking apparatus of configuration for enabling a paper supporter comprised of a wire member to be inserted in a sheet discharge part so as to place long-length sheets, and thereby enabling an extension tray capable of stacking discharged sheets to be attachable and detachable (e.g., see Patent Document 1).

Further, there is a proposed sheet stacking apparatus for enabling installation space to be variable by readily performing attaching and detaching of a sheet stacking section, and thereby using a stacking tray for long-length sheets (e.g., see Patent Document 2).

PRIOR ART DOCUMENT

Patent Document

[Patent Document 1] Japanese Patent Application Publication No. H9-278259

[Patent Document 2] Japanese Patent Application Publication No. 2017-154848

DISCLOSURE OF INVENTION

Problems to be Solved by the Invention

Long sheets long in the transport direction are hard to transport only by transport force given by a transport roller, and when an inclined angle of a discharge tray is made a too steep angle, there is the risk that a transport failure occurs. With respect to the long-length sheet, the sheet itself has weight due to the length, the surface area is also large, contact resistance to the tray is thereby large, and therefore, there is a fundamental problem that buckling and bowing is easy to occur. Hence, it is an issue to coexist with the conventional configuration for providing a tray with an inclined angle to enhance alignment characteristics to align. On the other hand, in the case where the apparatus exists on the further downstream side of the discharge tray in the transport direction, when a long tray is provided without forming the inclined angle, there is the risk of interference.

The present invention was made in view of the above-mentioned respect, and it is an object of the invention to provide a sheet stacking apparatus for maintaining alignment characteristics of long-length sheets without impairing convenience of users, in an apparatus provided with a long-length sheet stacking section.

Means for Solving the Problem

In order to attain the above-mentioned object, a sheet stacking apparatus according to the present invention is a sheet stacking apparatus above in a pair of sheet stacking apparatuses provided to overlap vertically along a vertical direction, and is provided with a first stacking section for stacking sheets, a second stacking section which is provided to extend from a downstream end of the first stacking section in a sheet transport direction and which is connected to the first stacking section rotatably, and a third stacking section which is attached to the second stacking section, provided to extend from a downstream end of the second stacking section in the sheet transport direction, and which is attachable and detachable with respect to the second stacking section in a rotation direction.

Herein, the second stacking section may be attached to the first stacking section rotatably. By this means, as necessary, it is possible to adjust a length and an installation area of the first stacking section in the transport direction.

Then, the third stacking section is comprised of an elastically deformable linear member, and the second stacking section is provided with a regulation portion for regulating a deformation shift of the linear member to prevent the linear member from being detached from the second stacking section.

Advantageous Effect of the Invention

According to the present invention, it is possible to install a discharge tray for storing long-length sheets neatly without exerting an effect on an apparatus connected on the downstream side.

MODE FOR CARRYING OUT THE INVENTION

A sheet stacking apparatus according to an Embodiment of the present invention will be described as an image forming apparatus provided with the sheet stacking apparatus with reference to drawings. The image forming apparatus according to this Embodiment includes a copier, printer, facsimile and complex apparatus thereof, and is the image forming apparatus provided with a sheet processing apparatus capable of performing alignment processing in a discharge direction on a sheet discharged to a stacking section.

Embodiment

<Entire Configuration of the Image Forming Apparatus>

Figure 1:
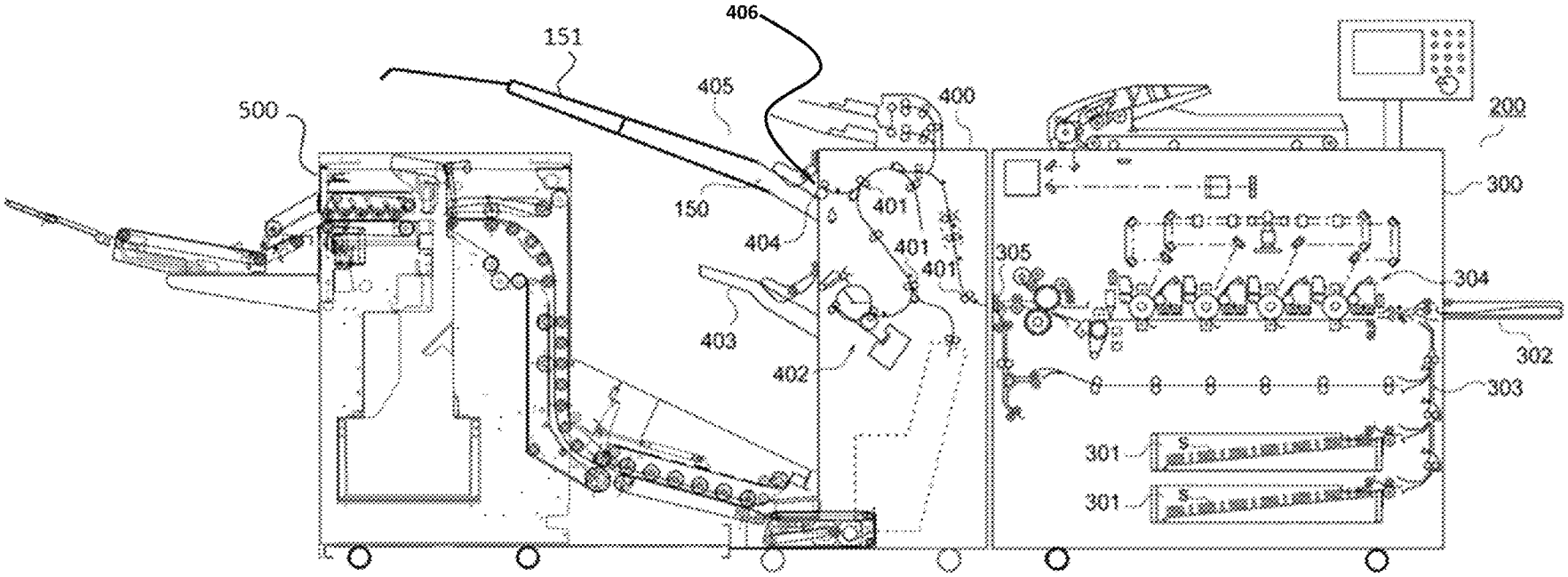
FIG. 1 shows an explanatory view of an image forming system provided with a sheet processing apparatus according to an Embodiment of the present invention.

FIG. 1 shows a side elevational view schematically illustrating an image forming apparatus 200 according to the Embodiment of the present invention, and the configuration of the image forming apparatus will be described below according to a flow of a sheet.

As shown in FIG. 1, the image forming apparatus 200 is provided with an image forming apparatus main body 300 for forming an image on a sheet S, and a sheet processing apparatus 400. The sheet processing apparatus 400 is configured to be attachable and detachable to/from the image forming apparatus main body 300, and is capable of being used as an option with respect to the image forming apparatus main body 300 capable of being used alone.

Further, on the downstream side of the sheet processing apparatus in a transport direction, it is also possible to attach and detach an additional post-processing apparatus 500 (hereinafter, trimmer 500), for example, such as a trimmer for trimming an end portion of a booklet, for performing additional post-processing on a sheet subjected to post-processing in a saddle stitch middle folding section (not shown in the figure) of the sheet processing apparatus 400.

Sheet cassettes 301 are packed in a lower portion of the image forming apparatus main body 300, and a manual feed tray 302 is provided in a side portion of the image forming apparatus main body 300. The sheet S set in each of the sheet cassettes 301 or the manual feed tray 302 is transported to an image forming section 304 by a sheet feed section 303 comprised of transport rollers.

The image forming section 304 of this Embodiment uses an electrophotographic scheme for sequentially transferring a toner image of each color of yellow, magenta, cyan and black formed on a photosensitive drum to a transported sheet, and heating the transferred toner image to fuse.

The sheet to which the toner image is transferred and fused in the image forming section 304 is transported to the sheet processing apparatus 400 by a discharge roller 305. The sheet processing apparatus 400 is installed on the downstream side of the image forming apparatus main body 300 in the sheet transport direction, and is to transport a plurality of sheets S fed from the image forming apparatus main body 300 to a staple section 402 by transport rollers 401, perform staple processing on the plurality of sheets, and then, discharge to a lower discharge section 403 that is a sheet stacking section provided below an upper discharge section 405 described later.

Further, the sheet processing apparatus 400 is also capable of discharging to the upper discharge section 405 that is a sheet stacking section provided above the lower discharge section 403, by the discharge roller 404, without branching the transported sheet to perform staple processing.

<Configuration of the Sheet Stacking Apparatus>

Next, descriptions will be given to the sheet stacking apparatus that is a feature of the image forming apparatus of this Embodiment. The sheet stacking apparatus described herein is a sheet stacking apparatus of the upper discharge section 405 for stacking sheets discharged from the sheet processing apparatus 400.

As shown in FIG. 1, the upper discharge section 405 is provided with an upper stacking tray 150 provided in a side face of the sheet processing apparatus 400 to be able to move up and down, and to the upper stacking tray 150 (first stacking section) is attached a rotation tray 151 (second stacking section) capable of performing a rotation shift.

The rotation tray 151 is configured to extend to the downstream side from an end portion of the upper stacking tray 150 in a sheet discharge direction, gains an area to support a long-length sheet lying off the end portion of the upper stacking tray 150 in discharging the sheet, and enables the long-length sheet to be stacked. Further, a third stacking section 152 is connected to the rotation tray 151, and will be described later. The upper stacking tray 150 constitutes the first stacking section according to the present invention, and the rotation tray 151 constitutes the second stacking section according to the present invention which is provided to extend from a downstream end of the upper stacking tray 150 in the sheet transport direction and which is connected to the rotation tray 151 rotatably.

The upper discharge section 405 is provided, on the upstream side in the sheet transport direction, with an erect face 406 for regulating a position in the transport direction of the sheet to stack, and over the entire upper discharge section 405, is given inclined angles so that the sheet shifts to the erect face 406 to align.

It is expected that long-length sheets are stacked in the upper discharge section 405, and there are many types of long-length sheets. Particularly, according to the size of weighing, there are differences in behavior of the sheet in the middle of discharging and/or at the time of stacking completion. For example, with respect to a sheet with small weighing i.e. a long-length sheet of the so-called thin paper (80 g/m$^2$ or less), in the middle of stacking on the tray, when a certain amount of sheets is transported, the front end in the transport direction is warped by transport resistance due to friction between the front end in the transport direction and the tray, there is a high possibility of buckling, and particularly, the tendency is more remarkable, as the sheet is farther apart from a discharge opening.

Figure 2A:
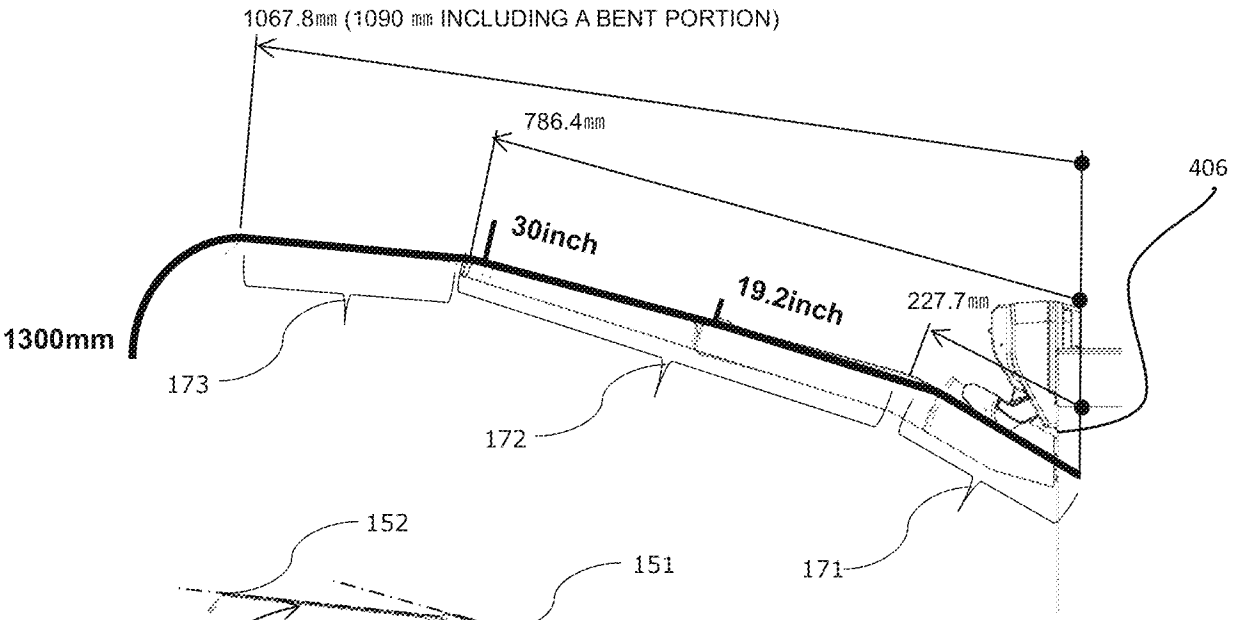
FIG. 2A shows an explanatory view of a position of a rear end in a transport direction in placing a sheet of each size on an upper stacking tray.
Figure 2B:
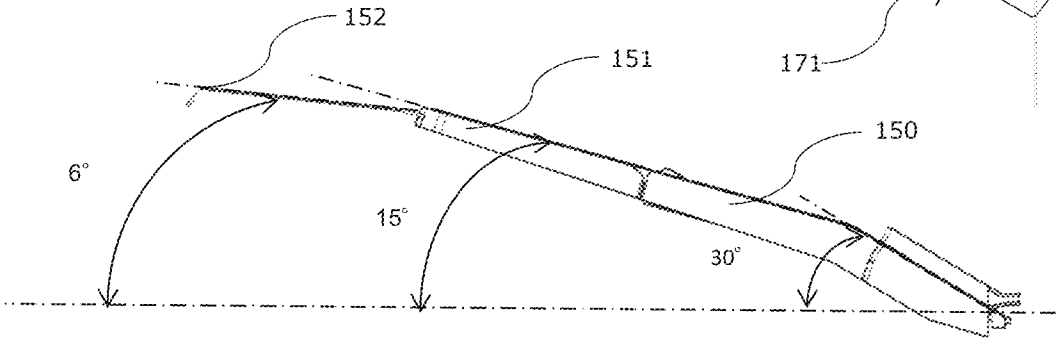
FIG. 2B shows an explanatory view of first, second and third inclined angles of the upper stacking tray.

Therefore, in this Embodiment, as shown in FIGS. 2A and 2B, the upper discharge section 405 is divided into three stages comprised of a first placing face 171 with the largest inclined angle in the section 405, a second placing face 172 with an inclined angle smaller than the angle of the first placing face 171, and a third placing face 173 with an inclined angle smaller than the angle of the second placing face 172, and is configured so that the inclined angle is more moderate, as the face is farther apart from the discharge opening. By this means, it is possible to reduce transport resistance also during discharge of the long-length thin paper, and it is thereby possible to actualize high alignment characteristics with few occurrences of buckling and the like.

On the other hand, in the so-called thick paper and the like (220 g/m$^2$ or more) with large weighing, for reasons that a transport velocity inside the image forming apparatus is originally lower (lower velocity) than the velocity of the thin sheet, and that friction resistance is high due to a large contact area with the tray, when the paper is discharged at a normal transport velocity, the so-called "rear end remaining" occurs such that the sheet rear end is caught in the discharge opening, or leans against the above-mentioned erect face 406. Therefore, in this Embodiment, in discharging the thick paper to the upper stacking tray 150, the discharge velocity given by the discharge roller is increased to reduce the occurrence of rear end remaining.

Figure 3B:
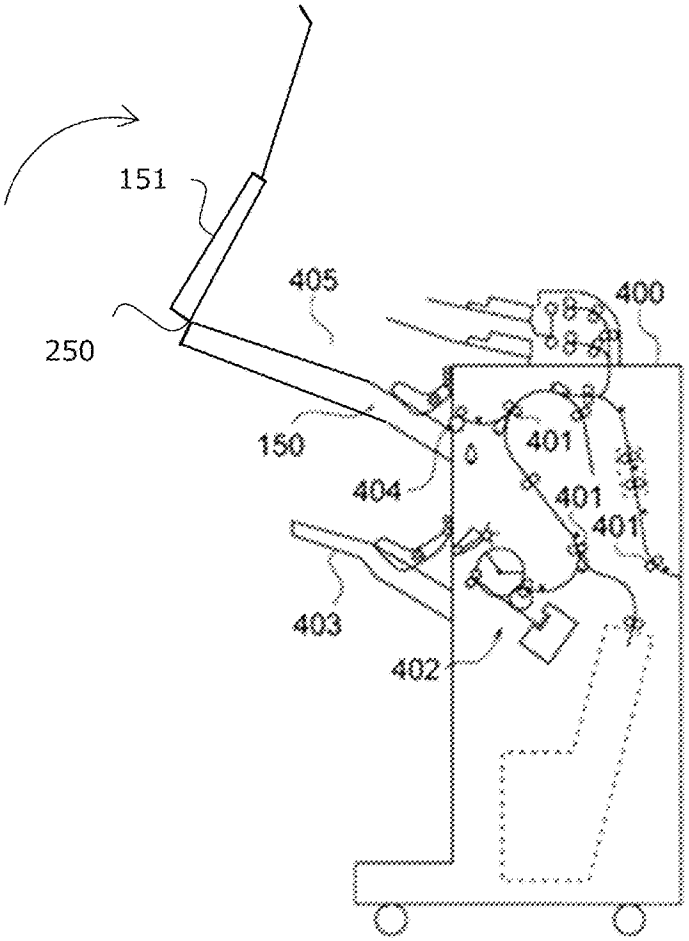
FIG. 3B illustrates a state in which the upper stacking tray extension portion is erected in another side elevational view.
Figure 3A:
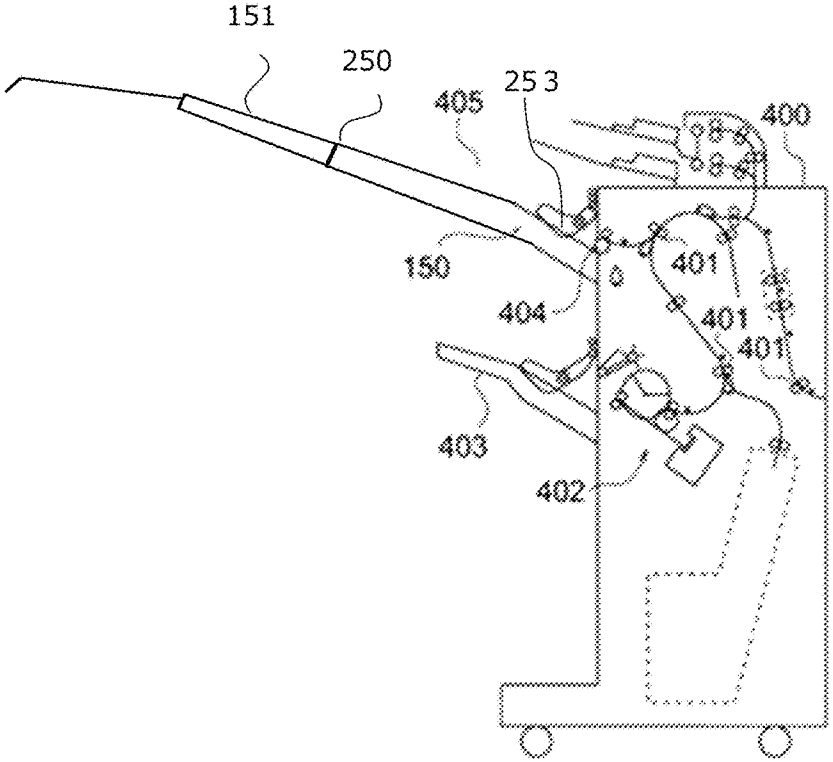
FIG. 3A illustrates a state in which an upper stacking tray extension portion is extended in a side elevational view.
Figure 4:
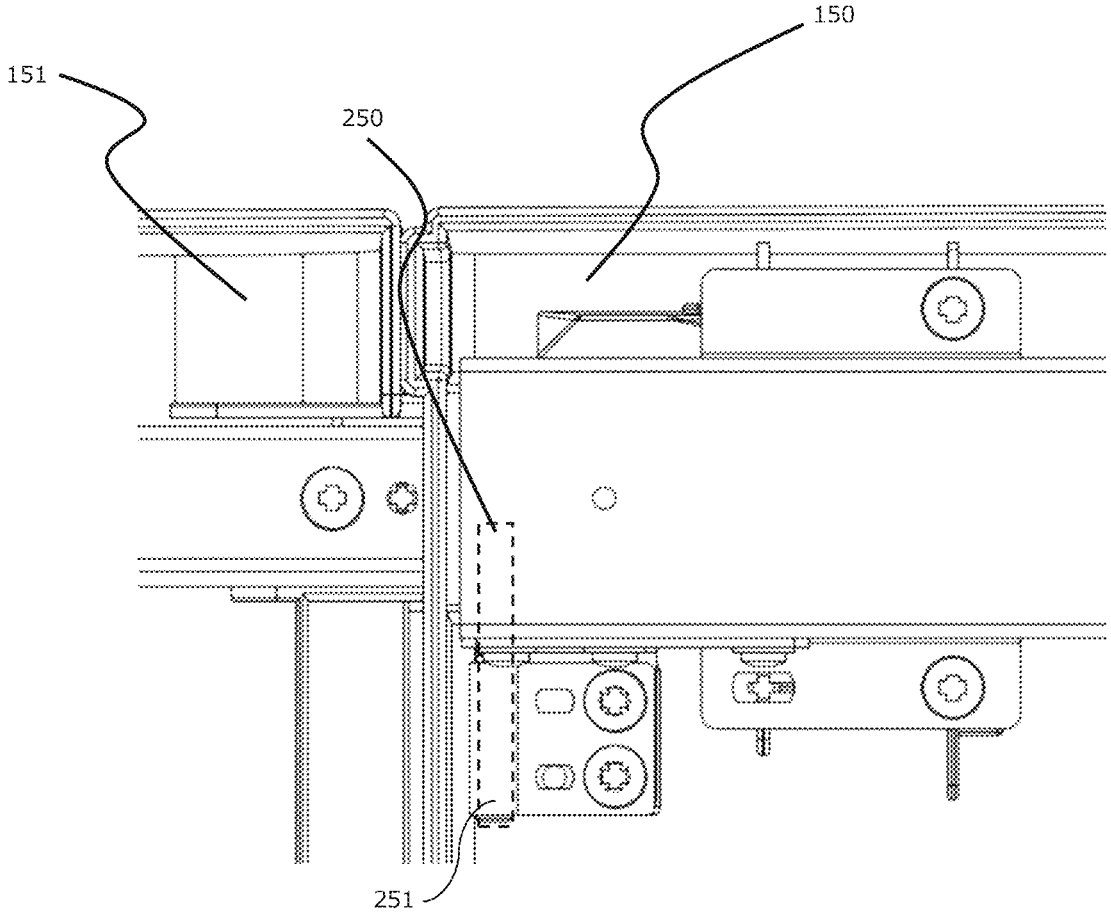
FIG. 4 shows an explanatory view from a top face of a connection portion between the upper stacking tray and a rotation tray.
Figure 5:
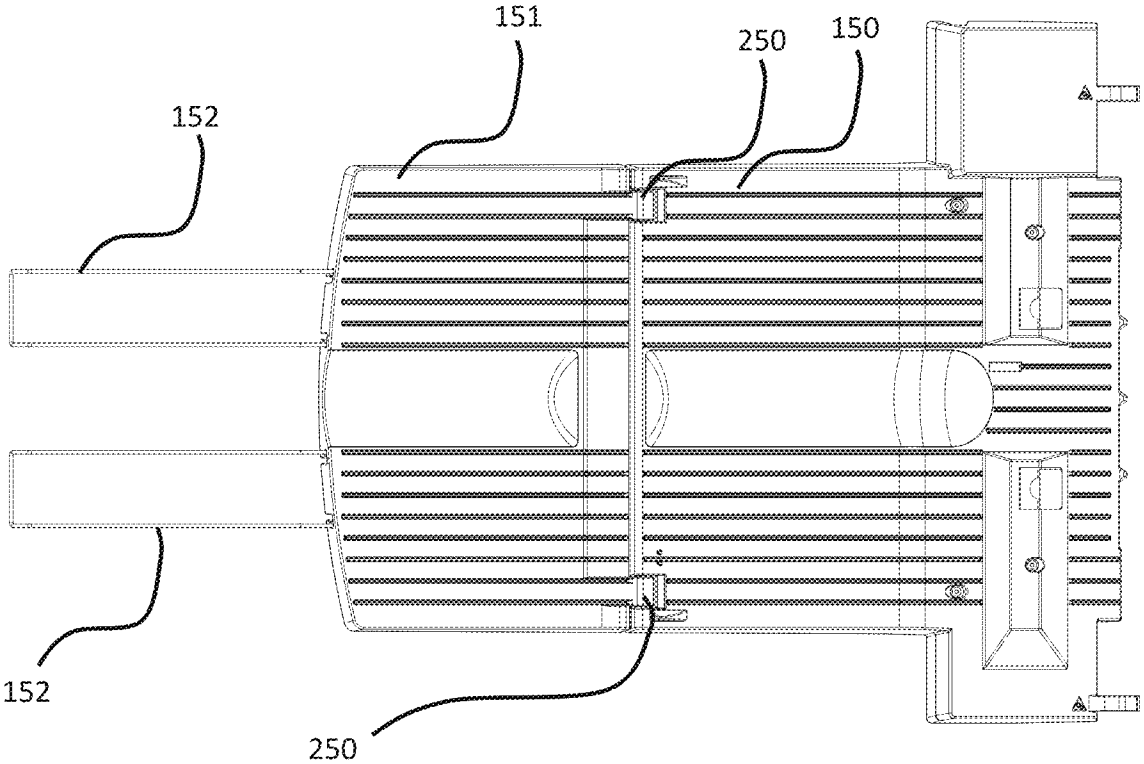
FIG. 5 shows an explanatory view from a top face of a rotation support portion of the upper stacking tray and a position in stacking 19-inch sheets.

As shown in FIGS. 3A and 3B, the rotation tray 151 is attached to the upper stacking tray 150 rotatably, and is capable of shifting to a rotation position where the tray is rotated and shifted in an upward direction so that the length of the upper stacking tray 150 is short in the transport direction, as necessary, such as the time the long-length sheet is not stacked, the time of removing sheets stacked on the lower stacking tray 403, the time of opening and closing a cover to release a sheet transport jam of the additional post-processing apparatus 500 (described as the trimmer 500 in this Embodiment) or the like. As shown in FIG. 4, into a rotation support 250 thereof is incorporated a damper 251 for regulating and attenuating the rotation speed, and the section 151 is made hard to fall, in the case of holding the second stacking section 151 in the position where the section is rotated and erected. The damper regulates the rotation by resistance between the shaft and the sleeve, and it is possible to adopt various damper mechanisms.

Figure 6:
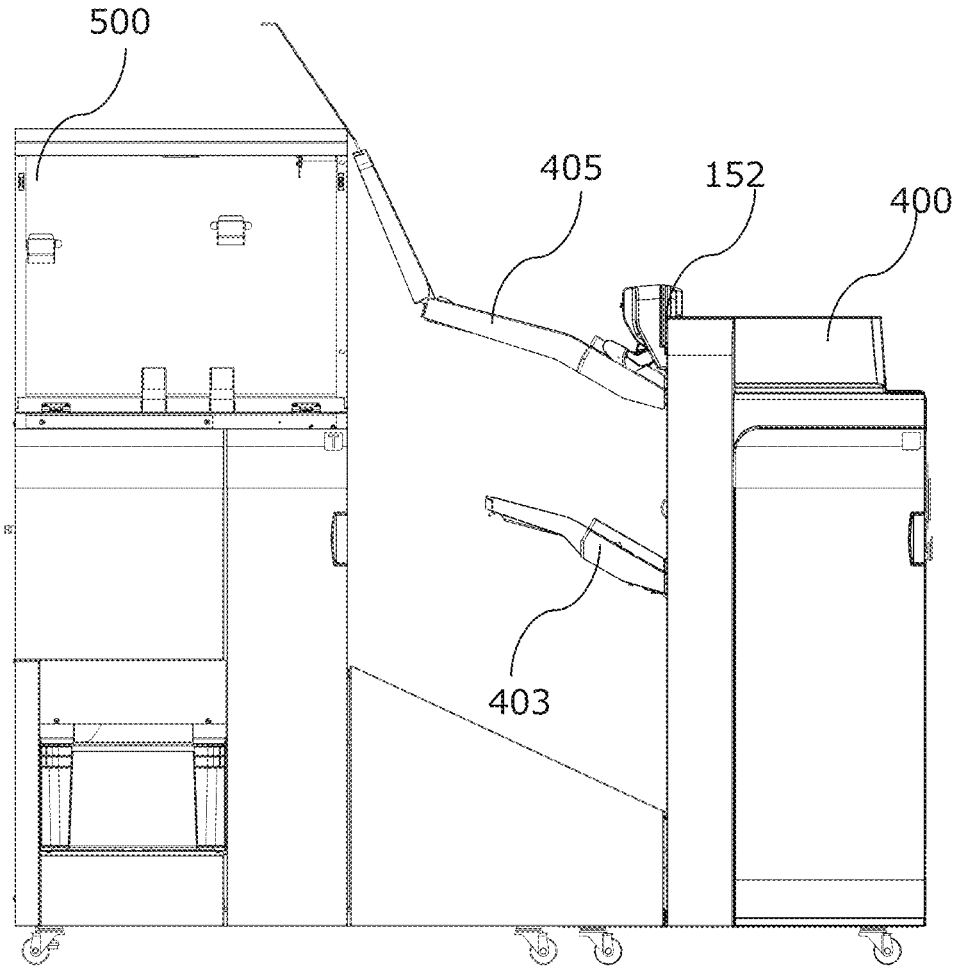
FIG. 6 shows an explanatory view of a state in which a jam processing cover is opened in a trimmer apparatus on the downstream side in the transport direction.

In this Embodiment, the rotation support 250 is provided between the upper stacking tray 150 and the rotation tray 151, and rotates so that the center of the above-mentioned second stacking face 172 is folded. As shown in FIGS. 2A, 2B, 5 and 7, the position of the rotation support 250 is set at a position longer than (exceeding) the end portion, in the sheet transport direction, of a 19-inch sheet having the highest frequency of being stacked in the upper stacking tray 150, and it is possible to rotate the rotation tray 151, while stacking the 19-inch sheet, and to open and close the jam processing cover of the trimmer 500. Further, as shown in FIG. 6, the position is set on the front side from the jam release cover end portion of the trimmer 500, and is thereby not staggered, and even when the jam release cover of the trimmer 500 is opened without rotating the rotation tray 151, it is also possible to rotate the tray, while opening the cover.

Figure 7:
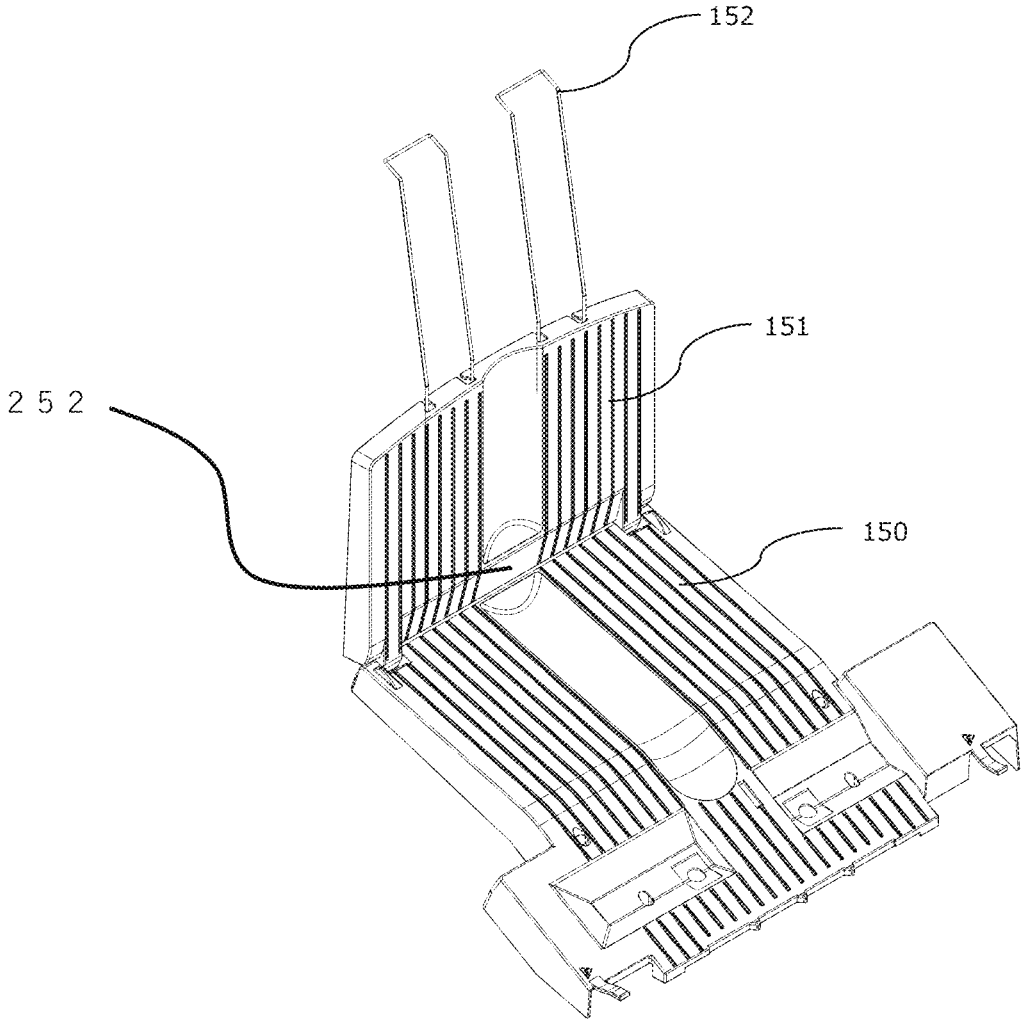
FIG. 7 shows an explanatory view of a notch portion.

Further, as shown in FIG. 7, in a stacking face of the rotation tray 151 connected by the rotation support 250, a notch portion 252 is formed so as to provide space to reduce inconveniences such that the sheet is given damage and/or shifted when the tray is rotated, while stacking sheets. In the notch portion 252, a length in a width direction crossing the sheet transport direction is also set at a length for accommodating the above-mentioned 19-inch sheet.

The upper discharge section 405 and lower discharge section 403 are provided with up-and-down mechanisms for moving a tray height in accordance with an amount of stacked sheets. The up-and-down mechanism may be any configurations such as a self-propelled scheme that the tray itself is provided with a drive motor and a rack-and-pinion scheme for transferring power of a drive motor provided on the housing side to move, and details thereof are also the general configuration, and therefore, are omitted herein. In addition, the upper discharge section 405 is in a position relationship that a part thereof overlaps an apparatus housing of the above-mentioned trimmer 500 in the transport direction. Therefore, a lower-limit position in moving the upper discharge section 405 up and down is set at a position where the section does not contact the apparatus housing of the above-mentioned trimmer 500.

Each of the upper discharge section 405 and lower discharge section 403 is provided with an alignment mechanism for aligning an end edge of the stacked sheet in the width direction crossing the transport direction. The alignment mechanism is comprised of the so-called neat alignment mechanism comprised of a plate-shaped member capable of rotating in the vertical direction and shifting in the width direction.

Figure 8:
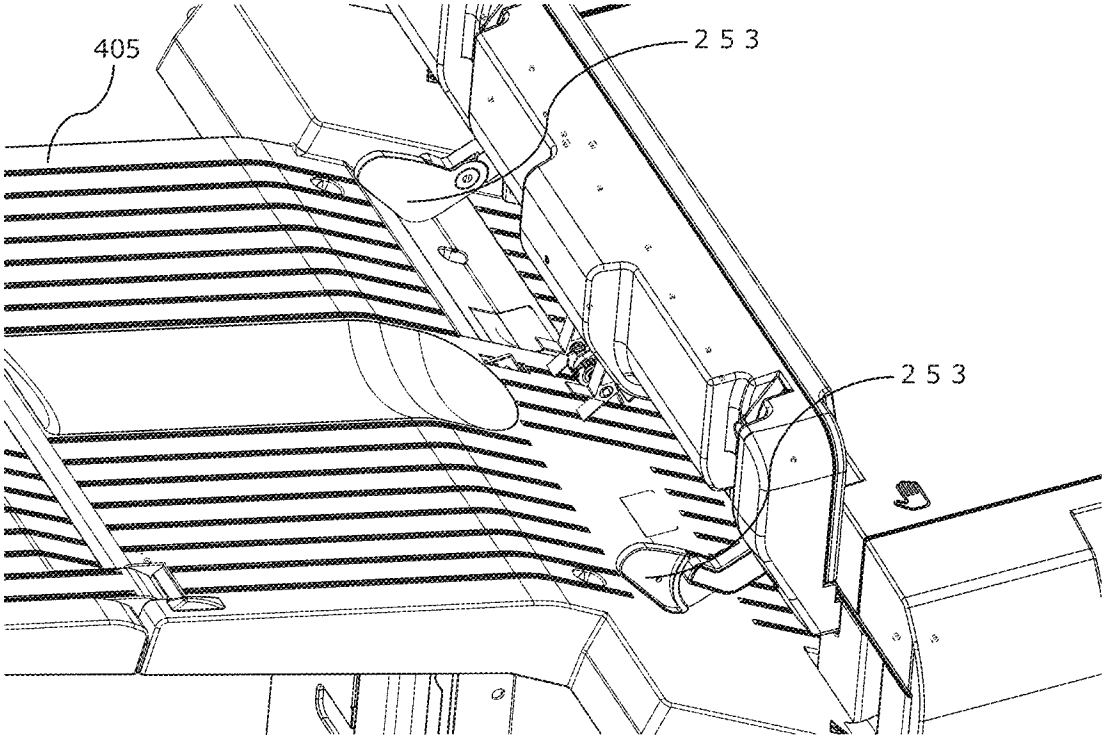
FIG. 8 shows an explanatory view of a neat alignment mechanism.

As shown in FIG. 8, the neat alignment mechanism 253 performs alignment processing on a sheet discharged to the upper discharge section 405, but does not perform the alignment processing on a long-length sheet. The long-length sheet is heavy in weight for each sheet, it is hard to remove when a large amount is stacked, and further, there is the case of causing damage to the sheet according to the case. Therefore, basically, it is recommended that an operator performs removal operation whenever a single sheet is discharged. Hence, in addition to interference with removal when alignment operation is performed by the neat alignment mechanism, there is also the risk of leading to a failure of the neat alignment mechanism, and therefore, with respect to the long-length sheet exceeding a predetermined length in the transport direction, this Embodiment adopts control for prohibiting operation of the neat alignment mechanism as described above.

Figure 9:
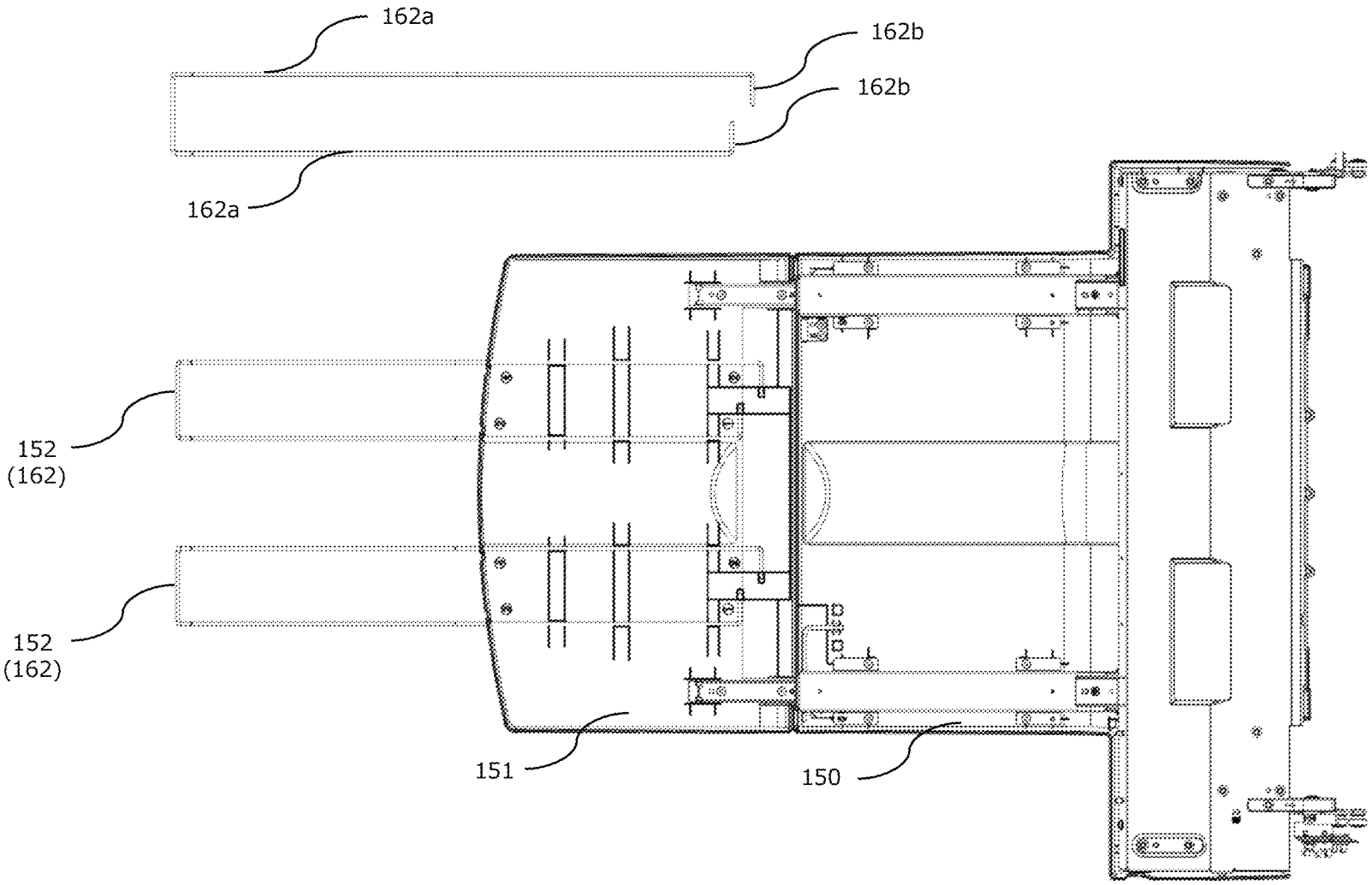
FIG. 9 shows an explanatory view of a third stacking section.
Figure 10:
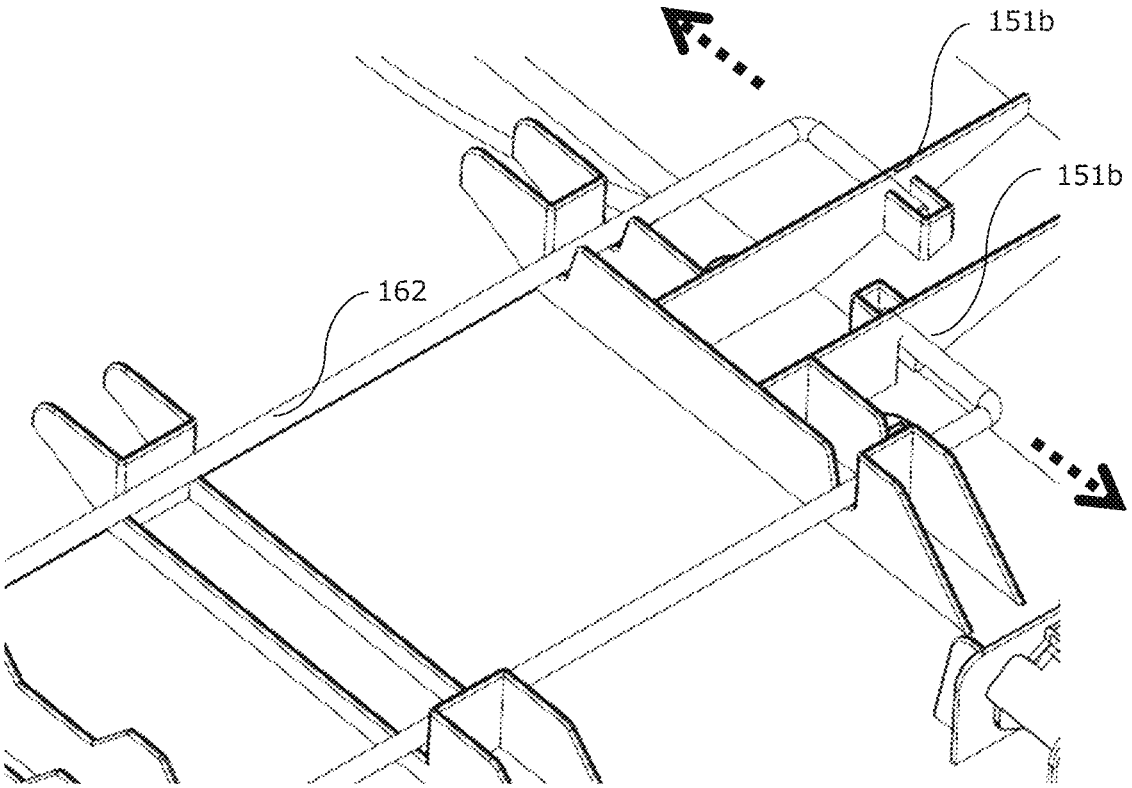
FIG. 10 shows an explanatory view of a regulation portion for regulating detaching of the third stacking section.
Figure 11:
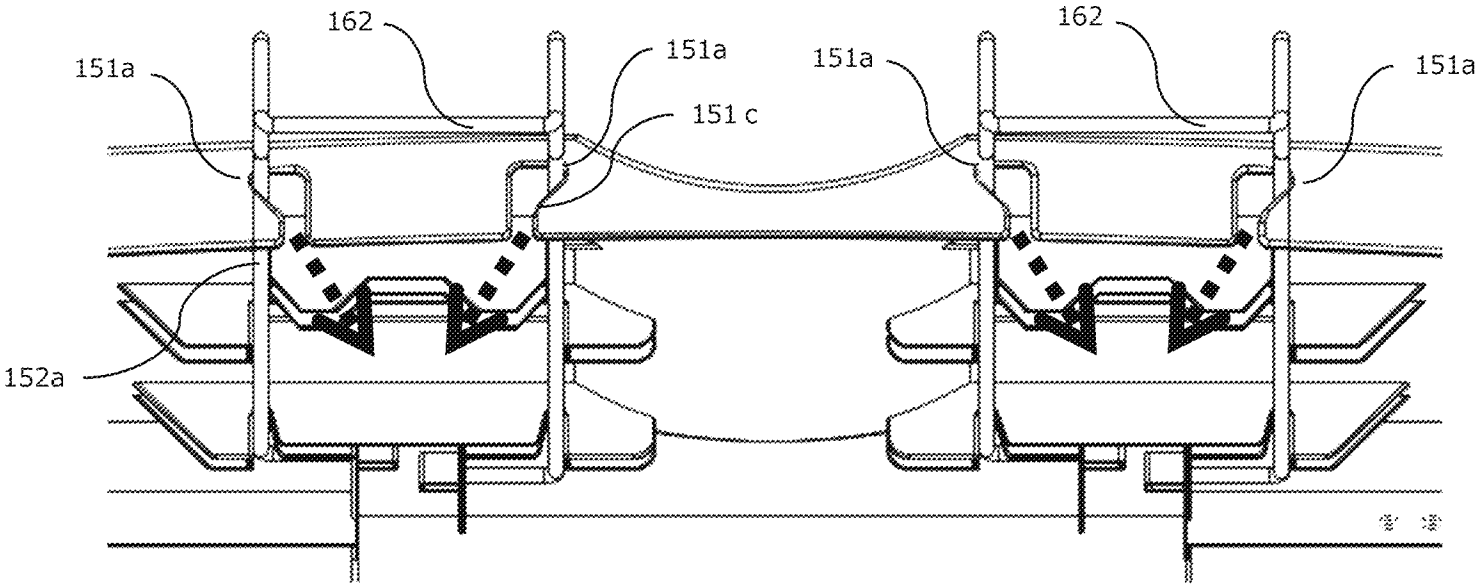
FIG. 11 shows another explanatory view of the regulation portion for regulating detaching of the third stacking section.
Figure 12:
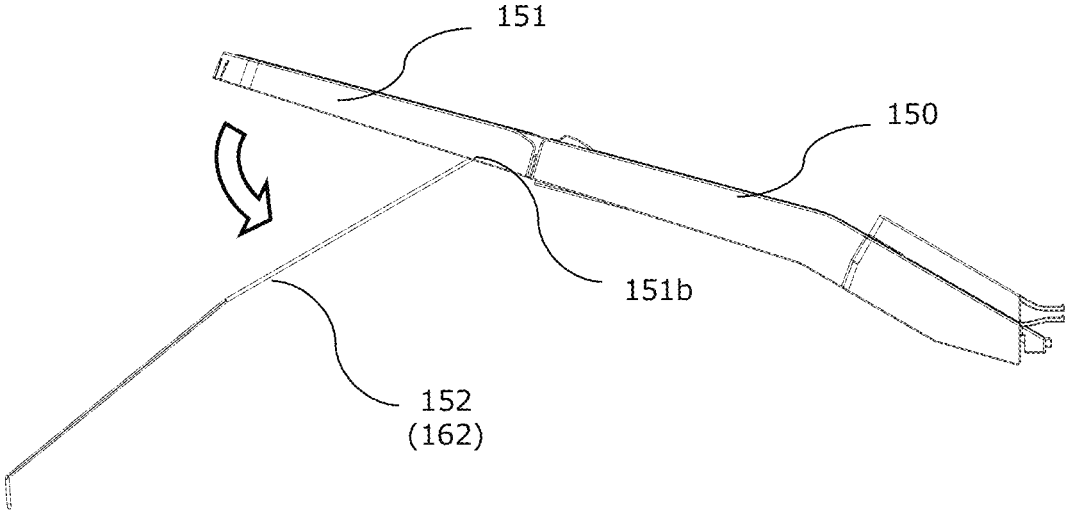
FIG. 12 shows a state view when a linear member is detached.

As shown in FIGS. 9 to 12, the third stacking section 152 forming the third placing face is configured to be attachable and detachable to/from the rotation tray 151 that is the second stacking section. The configuration for attaching the third stacking section 152 will be described below. In addition, FIG. 9 illustrates a position relationship between respective stacking sections and a shape of the third stacking section. FIG. 10 is a perspective view illustrating a position for attaching the third stacking section 152, FIG. 11 is a front view obtained by viewing the position from the transport direction, and FIG. 12 is an explanatory view of a state in which the third stacking section is detached.

The third stacking section 152 is formed by folding a linear member 162 capable of being elastically deformed, and in this Embodiment, two members (a pair) are disposed in a line in the width direction to function as one placing section, are wire-shaped members made of metal, and thereby have properties that modulus of elasticity is low to be easy to warp.

As shown in FIGS. 9 to 12, in the case of attaching the third stacking section 152, leg portions 162*b* of the linear member 162 are inserted in attachment holes 151*b* formed in the upper stacking tray 151, and linear portions 162*a* shown in FIG. 9 are warped to be inserted in attachment regulation portions 151*a* provided in the upper stacking tray 151.

As shown in FIGS. 9 to 11, the attachment regulation portion 151*a* is in the shape of a groove opened downward. The groove portion is provided with an expanding direction regulation portion and drop direction regulation portion, and the expanding direction regulation portion expands laterally using forces that the linear portions 152*a* are restored (see FIG. 10) when the linear portions 152*a* of the linear member 162 are warped and inserted, and makes a state of being pressed against the expanding direction regulation portion.

Then, the drop direction regulation portion for supporting the lower side of the linear portion 152*a* is provided below the expanding direction regulation portion, and is positioned in a position capable of stacking sheets. The drop direction regulation portion is provided with an inclined portion for moving the linear portion 152*a* in a direction for warping, as proceeding in the drop direction. By this means, as shown in FIG. 10, when a strong force is applied in the drop direction or the lateral direction, it is possible to prevent the linear member 162 from being detached, and thereby prevent deformation of the linear member 162 and failures of the rotation support 250 and up-and-down mechanism, and further, it is possible to enhance safety of the apparatus.

Further, the leg portions 162*b* are provided so that axes are positioned in different positions in the transport direction, the support point rotating in dropping is shifted, once a break is applied before detaching of the third stacking section 152, and it is thereby possible to weaken the impact in dropping.

As shown in FIG. 11, as described previously, the third stacking section 152 is configured so as to moderate the inclined angle for applying the force of moving the sheet in the direction opposite to the transport direction, and thereby prevents the sheet front end from buckling during transport. In addition to the inclined angle, the section is configured so that the contact area between the third stacking section 152 and the sheet is smaller than in the upper stacking tray 150 and rotation tray 151, and is thereby configured to reduce friction resistance.

Further, in contrast to that the length of the maximum-size sheet capable of being placed in the upper discharge section 405 is about 1300 mm, the entire length of the placing face of the upper stacking tray is set at about 1090 mm, and the front end of the maximum-size sheet is in a state of protruding from the tray at some midpoint in transport. The front end of the protruding sheet loses transport resistance because the placing face does not exist, the sagging sheet is further in a state of being pulled by gravity, the force in the transport direction is applied to the sheet as a result, and it is thereby possible to prevent the front-end portion of the sheet from buckling, while reducing the load of the transport motor.

In the above-mentioned sheet stacking apparatus, a placing tray of the long-length sheet is a communication face formed by continuation of the upper stacking tray (first stacking section) 150, rotation tray (second stacking section) 151 and third stacking section 152. Then, the placing tray is comprised of the first placing face 171 provided with the first inclined angle, the second placing face 172 provided with the second inclined angle smaller than the first inclined angle, and the third placing face 173 provided with the third inclined angle smaller than the second inclined angle.

Further, in the above-mentioned sheet stacking apparatus, by rotating the rotation tray 151, the rotation tray 151 and third stacking section 152 are erected, the communication face formed by continuation of the first placing face 171, second placing face 172 and third placing face 173 is bent in its center, and the user is thereby capable of readily removing sheets from the lower discharge section 403.

The invention claimed is:

1. A sheet placing apparatus for placing sheets, comprising:

a first placing face on which sheets are placed;

a second placing face provided on a downstream side of the first placing face in a sheet discharge direction, on which sheets are placed; and a third placing face provided on a downstream side of the second placing face in the sheet discharge direction, on which sheets are placed, wherein the second placing face is provided upwardly rotatably on the downstream side of the first placing face in the sheet discharge direction with an inclined angle with respect to a horizontal surface smaller than an angle of the first placing face, the third placing face is provided downwardly rotatably on the downstream side of the second placing face in the sheet discharge direction with an inclined angle with respect to the horizontal surface smaller than the angle of the second placing face, and the third placing face is provided to be attachable and detachable with respect to the second placing face in a rotation direction.

2. The sheet placing apparatus according to claim 1, wherein the third placing face is provided so that a contact area with the discharged sheet is smaller than in the second placing face.

3. The sheet placing apparatus according to claim 2, wherein the third placing face is comprised of a plurality of linear members capable of being elastically deformed, and the second placing face is provided with a regulation portion for regulating a deformation shift of the linear members.

4. The sheet placing apparatus according to claim 3, wherein the regulation portion of the second placing face faces downwardly, and the plurality of linear members is rotationally attached to the second placing face and elastically engaged with the regulation portion so that when a predetermined force is applied to the plurality of linear members in a drop direction, the plurality of linear members is disengaged from the regulation portion and rotates downwardly.

5. The sheet placing apparatus according to claim 1, wherein the second placing face is provided to rotate when a downstream end of the third placing face in a sheet transport direction interferes with a succeeding apparatus connected to the downstream side in the sheet transport direction.

6. An image forming apparatus comprising:

an image forming section adapted to form an image on a sheet; and the sheet placing apparatus according to claim 1 to stack the sheet with the image formed in the image forming section.

* * * * *